US007294096B1

(12) United States Patent
Stearns

(10) Patent No.: US 7,294,096 B1
(45) Date of Patent: Nov. 13, 2007

(54) TORSO EXERCISE METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 181 days.

(21) Appl. No.: 10/803,163

(22) Filed: Mar. 16, 2004

Related U.S. Application Data

(63) Continuation-in-part of application No. 10/718,763, filed on Nov. 21, 2003, now Pat. No. 7,108,642.

(51) Int. Cl.
*A63B 26/00* (2006.01)

(52) U.S. Cl. ..... 482/140; 482/72; 482/121

(58) Field of Classification Search ..... 482/51–52, 482/62–63, 72, 92, 95–96, 140, 142, 121–130, 482/148; D21/686, 690
See application file for complete search history.

(56) References Cited

U.S. PATENT DOCUMENTS 5,584,784 A * 12/1996 Wu ..... 482/95
5,586,959 A * 12/1996 Adkins et al. ..... 482/96
5,616,105 A * 4/1997 Wang et al. ..... 482/72
6,752,748 B1 * 6/2004 Scotti ..... 482/96
6,817,968 B2 * 11/2004 Galbraith et al. ..... 482/72
6,926,647 B1 * 8/2005 Huang et al. ..... 482/72

FOREIGN PATENT DOCUMENTS

WO WO9218204 A1 * 10/1992

* cited by examiner

*Primary Examiner*—Lori Amerson

(57) ABSTRACT

Exercise devices having a frame, and upper and lower force receiving members movably mounted on the frame and constrained to move in opposite directions. A resistance device is preferably interconnected between the frame and at least one of the force receiving members to resist movement of the members toward one another and/or to bias the members away from one another. The lower member is configured to support a person's feet, and the upper member is configured to support a person's hands and/or to engage a person's chest. The device facilitates a combination crunch and leg lift exercise that involves both a person's upper abdominal muscles and a person's lower abdominal muscles. The upper member may be resiliently supported in a manner that facilitates exercise of a person's oblique muscles, as well.

12 Claims, 21 Drawing Sheets

TORSO EXERCISE METHODS AND APPARATUS

CROSS-REFERENCE TO RELATED APPLICATION

This is a continuation-in-part of U.S. patent application Ser. No. 10/718,763, filed on Nov. 21, 2003 now U.S. Pat. No. 7,108,642.

FIELD OF THE INVENTION

The present invention relates to exercise equipment, and in particular, to torso exercise methods and apparatus.

BACKGROUND OF THE INVENTION

Various exercise devices have been developed to exercise various muscles of the human body, including a person's torso muscles. Many prior art devices primarily work only a person's upper abdominal muscles or a person's lower abdominal muscles. Other prior art devices effectively work both, and some such devices work a person's oblique muscles, as well. Generally speaking, the combination devices are either relatively complicated or relatively ineffective. In another words, a need remains for a relatively simple, yet thoroughly effective torso exercise device.

SUMMARY OF THE INVENTION

The present invention provides exercise apparatus and methods suitable for exercise of a person's torso muscles. A preferred embodiment of the present invention includes a seat mounted on a frame, an upper body support movably connected to the frame, and a lower body support movably connected to the frame and constrained to move upward in response to downward movement of the upper body support. Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals designate like parts and assemblies throughout the several views.

DETAILED DESCRIPTION OF A PREFERRED EMBODIMENT

Figure 1:
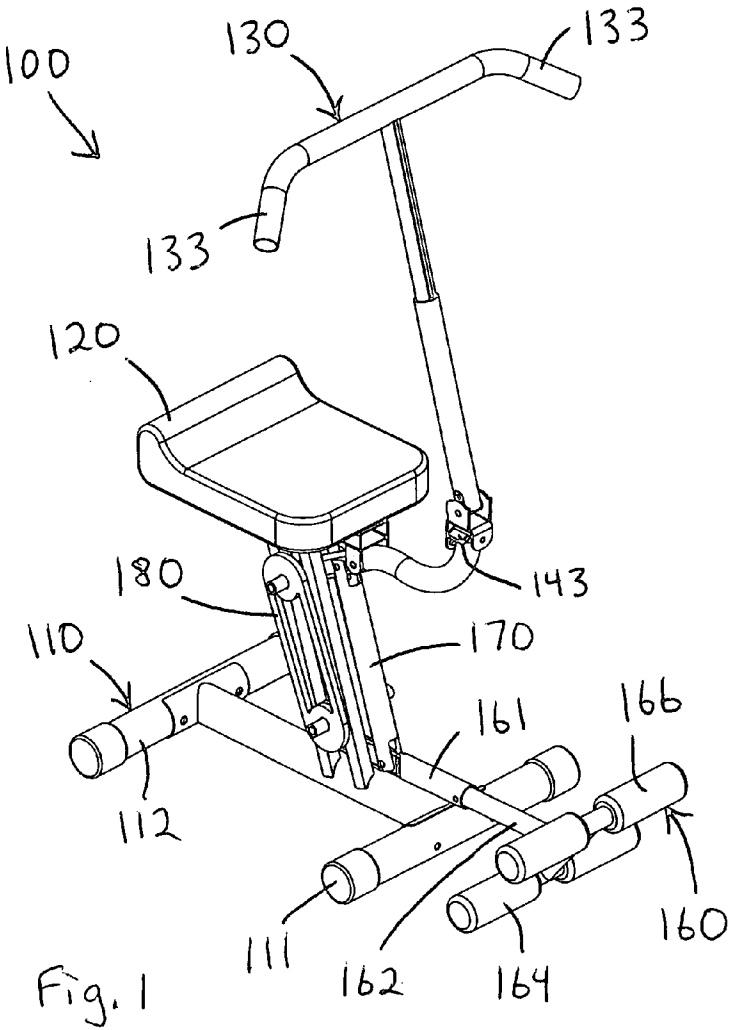
FIG. 1 is a perspective view of a preferred embodiment exercise device constructed according to the principles of the present invention.
Figure 2:
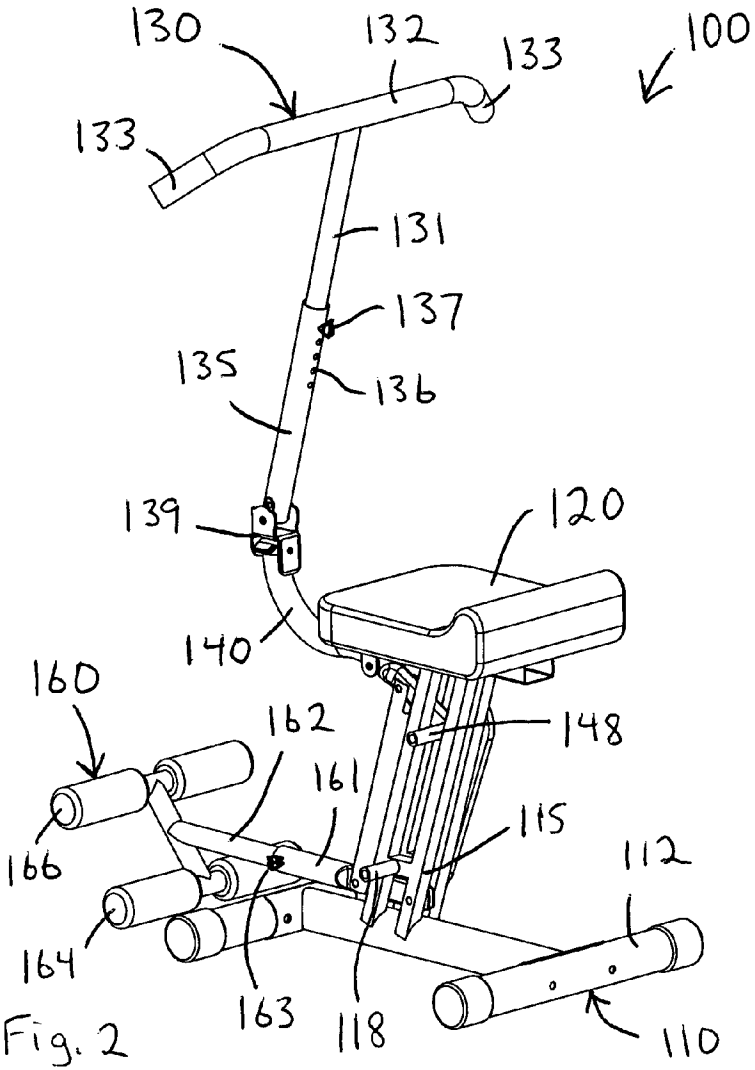
FIG. 2 is another, generally opposite perspective view of the exercise device of FIG. 1.
Figure 3:
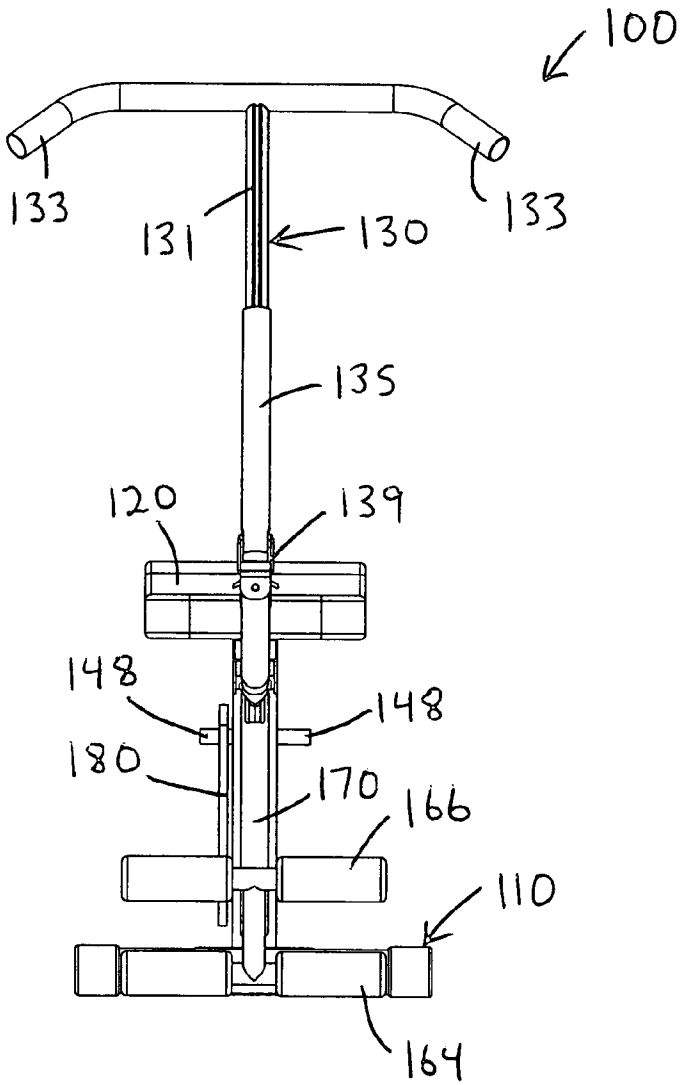
FIG. 3 is a front view of the exercise device of FIG. 1.
Figure 4:
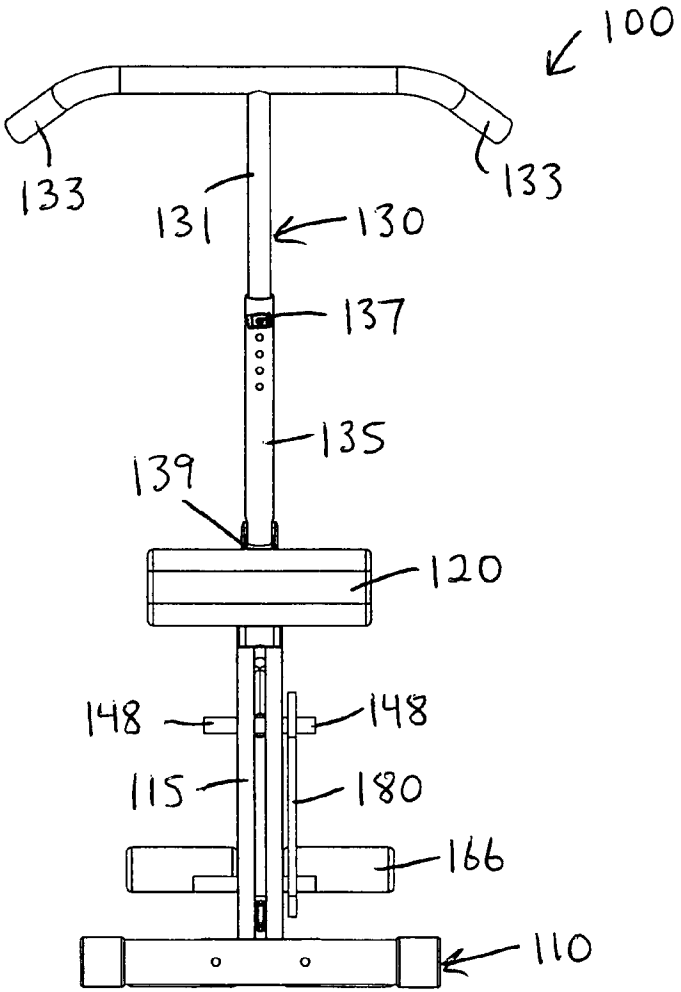
FIG. 4 is a back view of the exercise device of FIG. 1.

A first exercise device constructed according to the principles of the present invention is designated as 100 in FIGS. 1-8. The device 100 may be described generally in terms of a frame, an upper body support movably mounted on the frame, a lower body support movably mounted on the frame, and a means for biasing the upper body support toward an upper end of the frame, and for biasing the lower body support toward the lower end of the frame.

The frame may take various shapes and/or be made in various manners. On the device 100, the frame 110 includes a floor engaging base that is I-shaped and extends from a forward end 111 to a rearward end 112. An intermediate stanchion 115 is rigidly connected to an intermediate portion of the base, and extends upward and rearward from the base. The stanchion 115 comprises four bars that define gaps therebetween.

Figure 7:
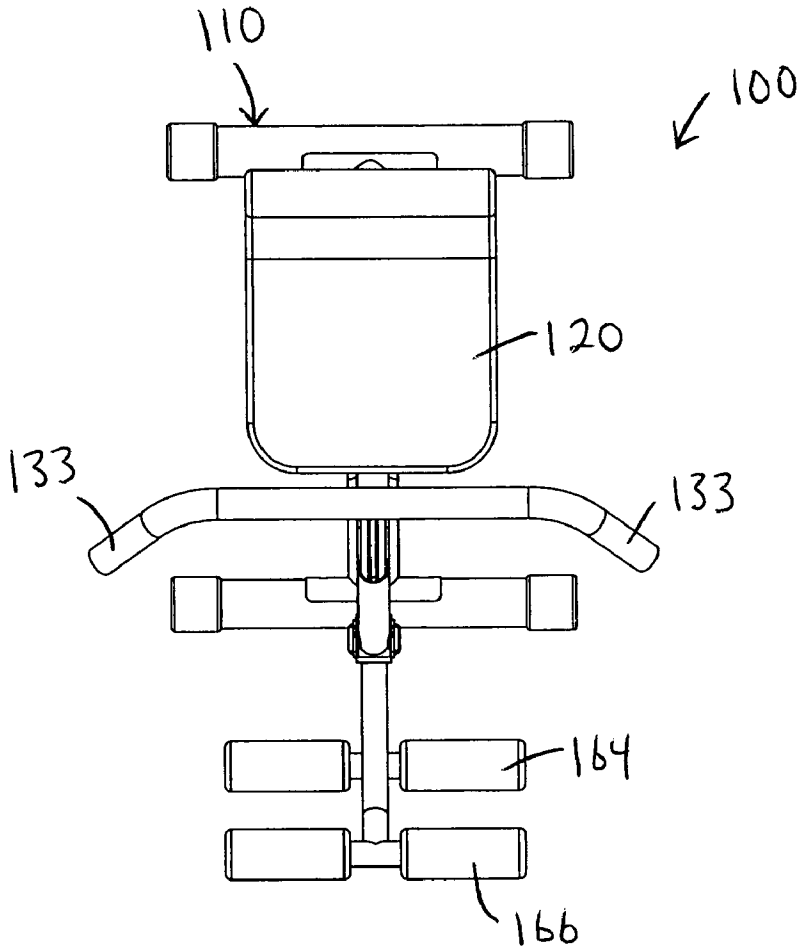
FIG. 7 is a top view of the exercise device of FIG. 1.
Figure 8:
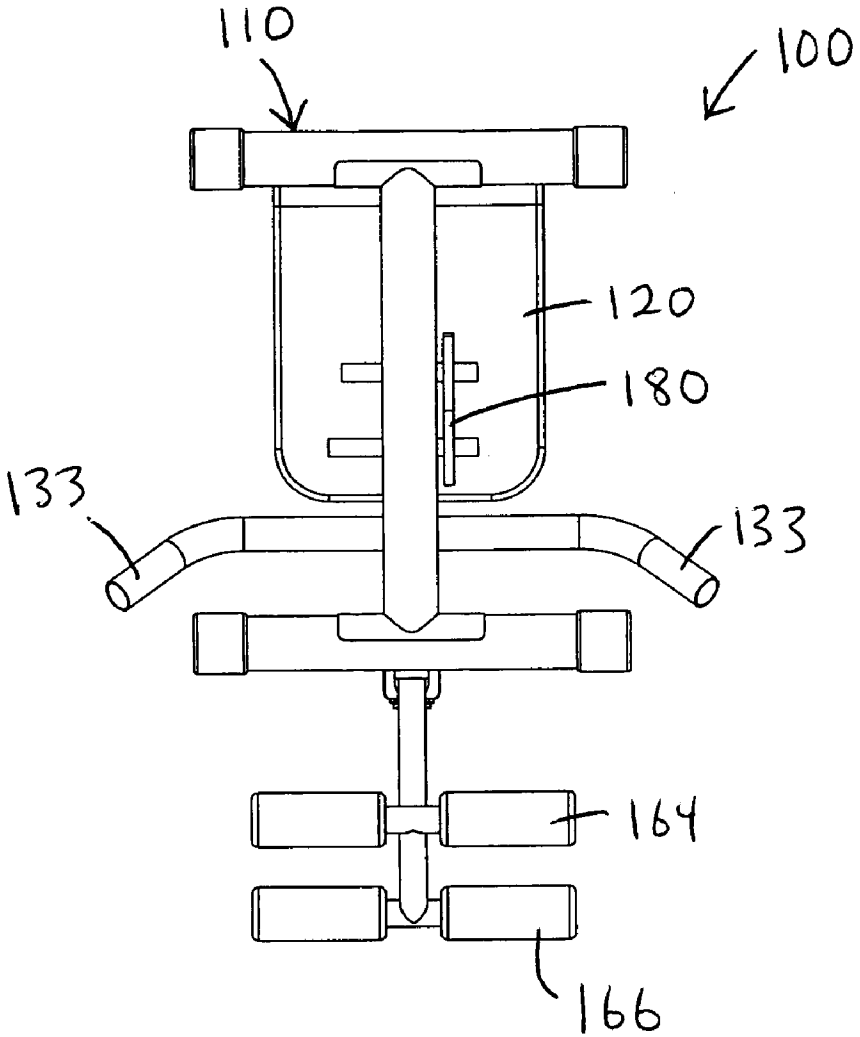
FIG. 8 is a bottom view of the exercise device of FIG. 1.

The seat 120 is rigidly mounted on top of the stanchion 115. The seat 120 preferably includes a covered padded portion and an underlying support structure. A trunnion 124 is mounted beneath the forward end of the seat 120 for reasons discussed below. On the device 100, an upwardly extending back support is provided along the rear edge of the seat 120. Among other things, the seat 120 may be described as sized and configured to support a person in a seated position above an underlying floor surface. FIG. 7 shows a top view of the apparatus 100, and illustrates to what extent other components are disposed beneath the planform of the seat 120.

A curved bar 140 has an intermediate portion that is pivotally connected to the trunnion 124, thereby defining a pivot axis X (labeled in FIG. 5) that extends beneath the planform defined by the seat 120. The bar 140 is configured and arranged in such a manner that a forward end of the bar 140 is disposed in front of the seat 120. A universal joint bracket 139 is mounted on the forward end of the bar 140, thereby defining a lower pivot axis that extends "fore-to-aft" and an upper pivot axis that extends "side-to-side". The bracket 139 pivots side-to-side about the lower axis relative to the bar 140. As shown in FIG. 1, tabs 143 project outward from opposite sides of the bracket 139 to limit pivoting of the bracket 139 relative to the bar 140.

Figure 5:
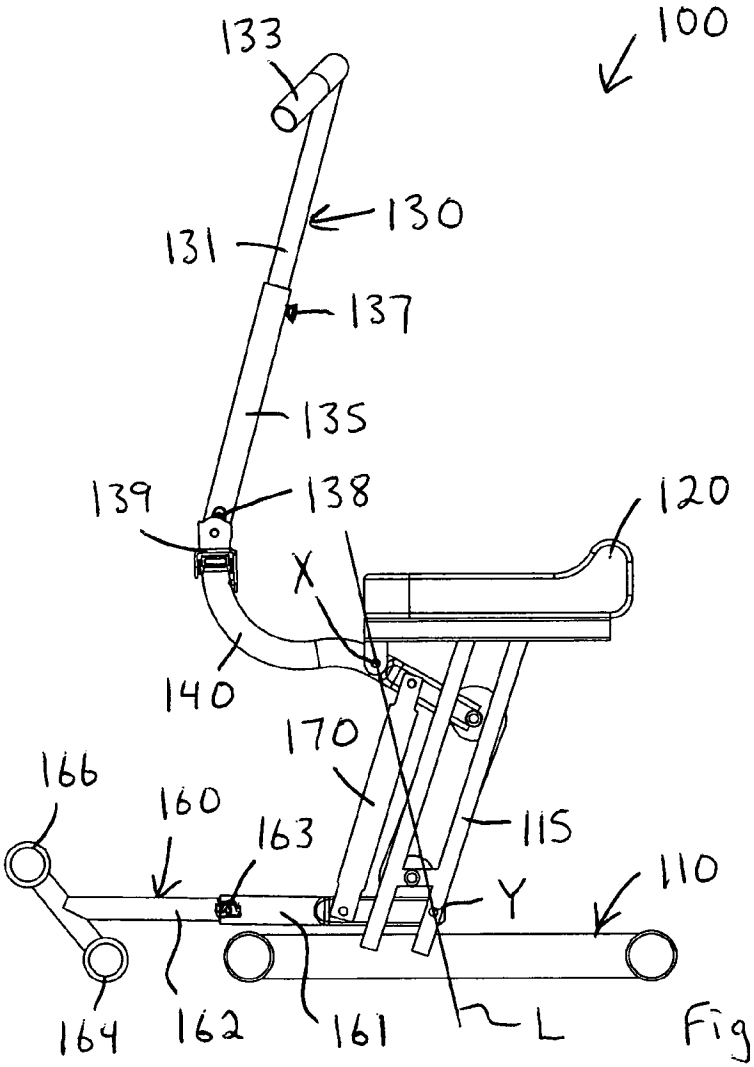
FIG. 5 is a side view of the exercise device of FIG. 1.
Figure 6:
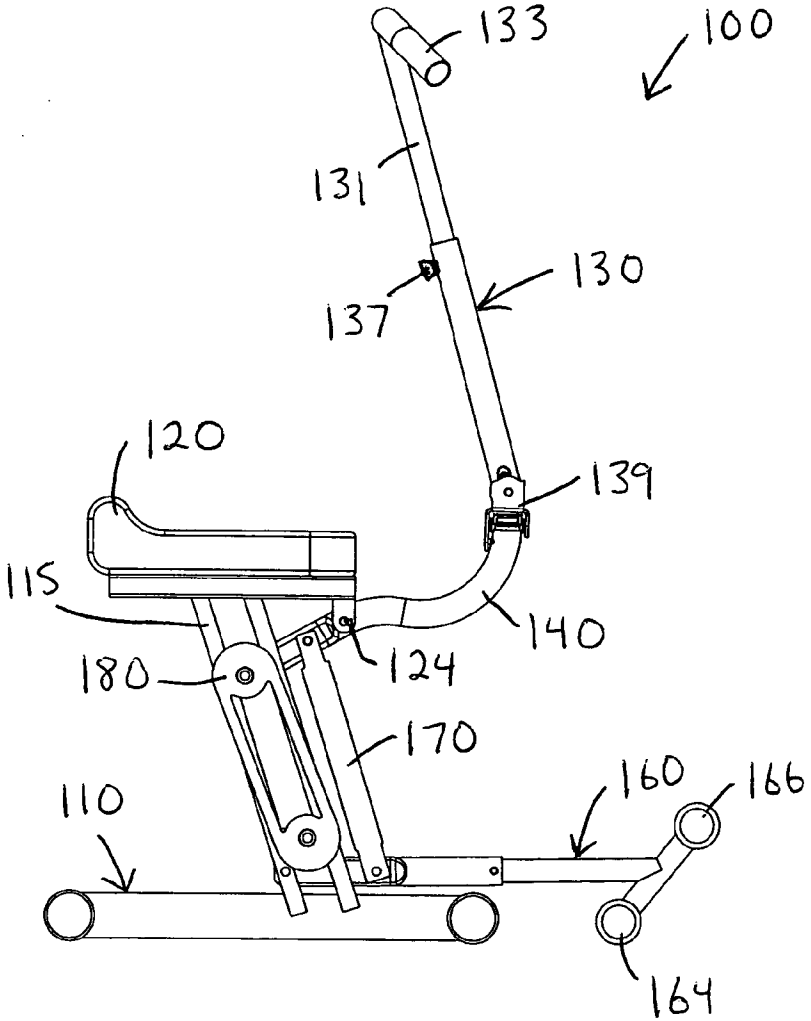
FIG. 6 is an opposite side view of the exercise device of FIG. 1.

A tube 135 has a lower end pivotally connected to the bracket 139 at the upper pivot axis. As a result, the tube 135 pivots fore-and-aft relative to the bracket 139, and side-to-side together with the bracket 139. As shown in FIG. 5, pegs 138 project outward from opposite sides of the tube 135 and cooperate with the bracket 139 to limit pivoting of the tube 135 relative to the bracket 139. A sleeve or bellows (not shown) is preferably disposed about the universal joint both for aesthetic purposes and to cover potential pinch points.

A bar 131 has a lower end that slides or telescopes inside the tube 135. As suggested by FIGS. 1 and 3, the bar 131 is also preferably keyed to the tube 135 to prevent relative rotation therebetween. In this regard, a nub on the tube 135 projects into a groove extending along the bar 131. As a result of the key arrangement, a hole in the bar 131 aligns with any one of a series of holes 136 in the tube 135 to receive a ball-detent pin 137 or other suitable fastener. A cross-bar 132 has an intermediate portion that is rigidly mounted on the upper end of the bar 131. Opposite ends 133 of the cross-bar 132 are angled downward and forward, and may be described as hand grips that are sized and configured for grasping. The members 131, 132, and 140 may be collectively described as a handlebar or an upper body support 130.

The upper body support 130 is configured and arranged to place the hand grips 133 within comfortable reach of an average adult person sitting on the seat 120, and to place the center of the cross-bar 132 proximate the person's chest. A chest pad may be mounted on the intermediate portion of the cross-bar 132 to provide a comfortable bearing member for the person's chest. Moreover, in order to accommodate people with different heights and/or reaches, the fastener 137 and associated holes allow the cross-bar 132 and hand grips 133 to be adjusted upward and downward, and the upper pivot axis on the universal joint bracket 139 allows the cross-bar 132 and associated hand grips 133 to be pivoted fore and aft.

An intermediate portion of the bar 140, disposed rearward of the trunnion 124, is pivotally connected to the upper end of a link 170. An opposite, lower end of the link 170 is pivotally connected to an intermediate portion of a tube 161. A rearward end of the tube 161 is pivotally connected to the stanchion 115, thereby defining a pivot axis Y (labeled in FIG. 5) that extends beneath the planform defined by the seat 120. The bar 140 is arranged to intersect or cross over a line L (shown in FIG. 5) drawn perpendicularly through both the pivot axis Y and the pivot axis X.

A bar 162 has a rearward end that is mounted inside a forward end of the tube 161. In a manner similar to the bar 131, the bar 162 may be telescopically mounted inside the tube 161, keyed relative to the tube 161, and adjusted relative to the tube 161 by means of a ball-detent pin 163 inserted through a hole in the tube 161 any one of a series of holes in the bar 162. In the alternative, the bar 162 may simply be bolted to the tube 161 or connected via a hinge.

A foot supporting assembly is mounted on a forward end of the bar 162. The assembly may be described as a "sideways" H, with the center of the H rigidly connected to the bar 162. Left and right lower foot members 164 extend in respective directions away from the center of the H. The members 164 are sized and configured to support a person's feet, and are preferably padded by foam tubes or other suitable means. Left and right upper foot members 166 extend in respective directions away from the center of the H. The members 166 are similarly padded, and are sized and configured to overlie a person's feet. The members 164 and 166 cooperate with the bar 162 and the tube 161 to define a lower body support 160 that can receive both pushing and pulling forces exerted through a person's feet. In a first mode of operation, a person site on the seat 120 with his legs straddling the upper body support 130, and places his feet on respective sides of the lower body support 160.

The link 170 constrains the lower body support 160 and the upper body support 130 to pivot in opposite directions relative to the frame 110. For example, downward movement of the upper body support 130 causes upward movement of the lower body support 160, and upward movement of the lower body support causes downward movement of the upper body support 130. In the absence of a dedicated resistance device, these movements may be performed on the apparatus 100 subject to the force of gravity acting on the mass of the user's legs.

The device 100 is also provided with structure to accommodate additional resistance or biasing means in the form of at least one elastic band 180. This type of resistance band 180 is well known in the art and used on other types of known exercise equipment. The resistance band 180 is releasably mounted on the apparatus 100 by means of pegs 118 and 148. In this regard, left and right pegs 118 are rigidly secured to the frame 110, and project outward from respective sides of the stanchion 115 just above the floor engaging base. Also, left and right pegs 148 are rigidly secured to a rearward end of the bar 140, and project outward from respective sides of the bar 140. The bar 140 projects rearward through a gap in the stanchion 115 to meet the pegs 148, which project laterally through opposite side gaps in the stanchion 115.

Each peg 118 and 148 is configured to fit into a hole in a respective end of the elastic band(s) 180. Means may be provided on the pegs 118 and 148 and/or the band(s) 180 to help secure the band(s) in place on the pegs. Furthermore, the pegs 118 and 148 may be spaced in such a manner that the band(s) 180 are always in tension when mounted on the pegs. Each band 180 mounted on the pegs 118 and 148 will resist downward movement of the upper body support 130 and thus, upward movement of the lower body support 160, as well.

Figure 9:
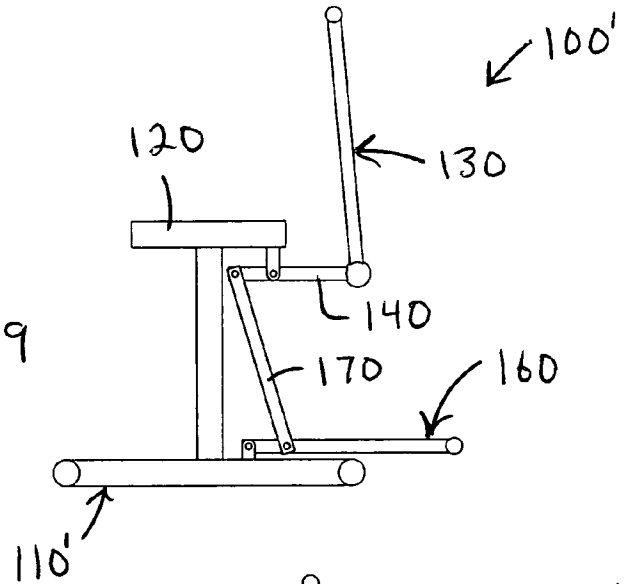
FIG. 9 is a diagrammatic side view of the exercise device of FIG. 1, showing the device in a rest position.
Figure 10:
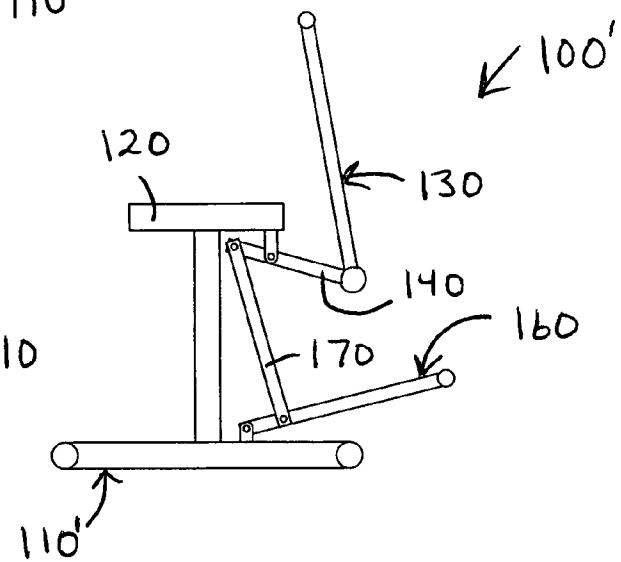
FIG. 10 is a diagrammatic side view of the exercise device of FIG. 1, showing the device in an active position.

The present invention facilitates exercise of a person's upper abdominal muscles (by user force exerted downward against the hand grips 133 and/or a pad on the cross-bar 132), and exercise of a person's lower abdominal muscles (by user force exerted upward against the foot members 166). The present invention also encourages contemporaneous exercise of all of the abdominal muscles by coordinating movement of the upper and lower force receiving members 130 and 160. As shown in FIGS. 9-10, wherein the above-described device is shown diagrammatically and designated as 100', the upper body support 160 is constrained to move upward in response to downward movement of the upper body support 130. As suggested by FIGS. 9-10, the device 100' may be built and/or operated without any resistance above and beyond the weight of a person's legs resting on the lower body support 160.

The present invention also facilitates exercise of a person's oblique muscles (by movement of the force receiving members 130 and 160 while the user occupies a "twisted" position on the apparatus 100). In alternative modes of operation, exercise of the oblique muscles may be achieved by turning to either side of the seat 120, lifting upward with one's feet while both feet are positioned on one side of the lower body member 160, and/or pushing downward on the upper body member 130 while displacing it laterally, as well.

Figure 11:
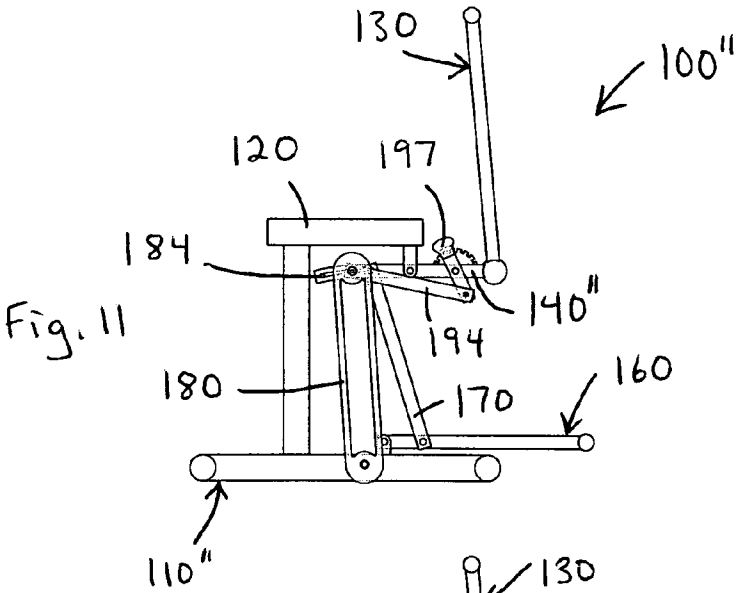
FIG. 11 is a side view of a second exercise device constructed according to the principles of the present invention.
Figure 12:
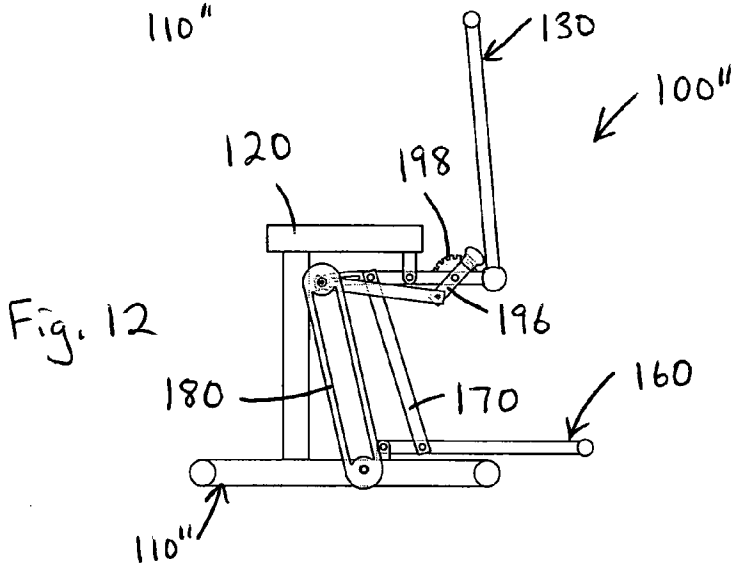
FIG. 12 is a side view of the exercise device of FIG. 11, showing the device at a different resistance setting.

There are other ways to implement the present invention using a conventional elastic band to provide resistance. For example, FIGS. 11-12 show a device 100" that is similar to the device 100, except for the resistance arrangement. In this regard, a conventional elastic band 180 has a lower end that is secured to the frame 110", and an upper end that is movably connected to the bar 140". More specifically, the upper end of the band 180 is connected to the rearward end of a link 194 which in turn, is slidably mounted in an arcuate slot 184 defined by the bar 140". The slot 184 is centered about the connection point between the band 180 and the frame 110".

An opposite, forward end of the link 194 is pivotally connected to the lower end of a lever 196. An intermediate portion of the lever 196 is pivotally mounted on the bar 140", and an upper end 197 of the lever 196 is configured for user manipulation into and out engagement with a series of notches in a bracket 198 that is mounted on top of the bar 140". The notches are arranged in an arc about the pivot axis defined by the lever 196.

When the device 100" is configured as shown in FIG. 11 (with the band 180 relative forward in the slot 184), the band 180 is stretched a first amount in response to a given amount of downward pivoting of the upper body support 130. When the device 100" is configured as shown in FIG. 12 (with the band 180 relative rearward in the slot 184), the band 180 is stretched a greater, second amount in response to the same given amount of downward pivoting of the upper body support 130. In other words, FIG. 11 shows the maximum resistance setting, and FIG. 12 shows the minimum resistance setting. The arcuate slot 184 is configured and arranged so the user can adjust the resistance without exerting force on the band 180.

Figure 13:
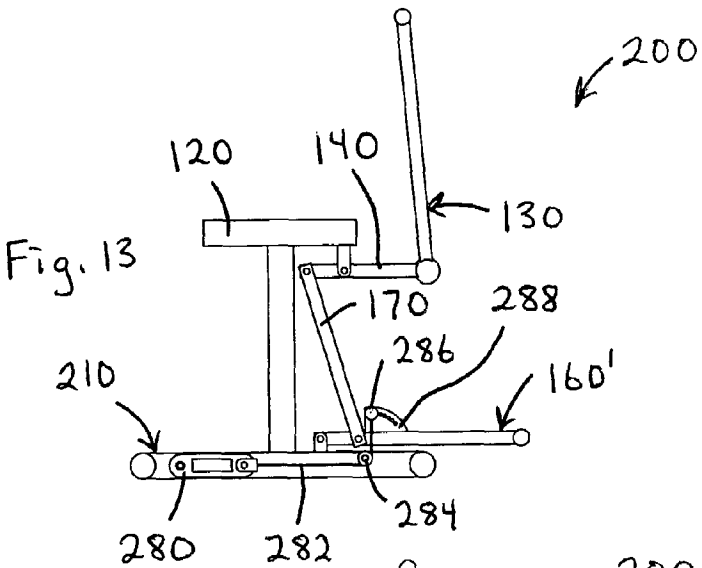
FIG. 13 is a side view of a third exercise device constructed according to the principles of the present invention.
Figure 14:
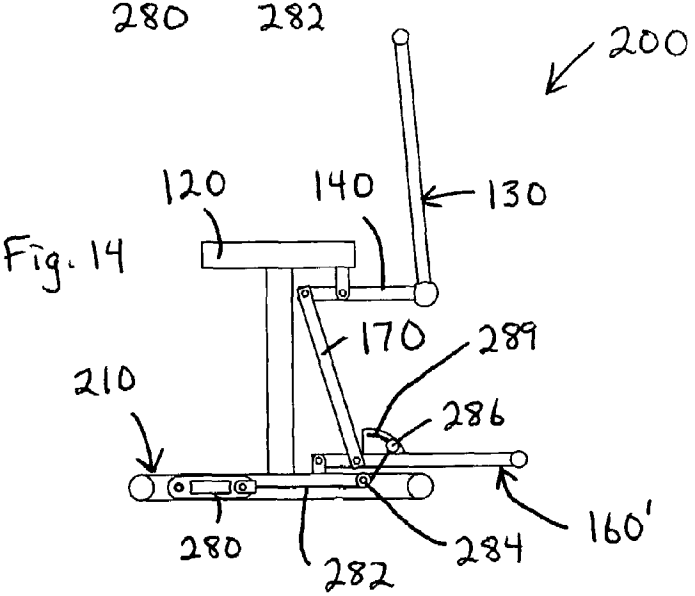
FIG. 14 is a side view of the exercise device of FIG. 13, showing the device at a different resistance setting.

FIGS. 13-14 show another device 200 that is similar to the device 100 except for the resistance arrangement. In this regard, a conventional elastic band 280 has a rearward end secured to the frame 210, and a forward end secured to the rear end of a cable 282. The cable 282 is routed about a pulley 284 on the frame 210, and an opposite, forward end of the cable 282 is configured to receive and/or retain a fastener 286. A bracket 288 is rigidly mounted on the lower leg support 160', and the fastener 286 is inserted through one of several holes 289 in the bracket 288.

When the device 200 is configured as shown in FIG. 13 (with the fastener 286 in the rearwardmost hole 289), the band 280 is stretched a first amount in response to a given amount of upward pivoting of the lower body support 160'. When the device 200 is configured as shown in FIG. 14 (with the fastener 286 in the forwardmost hole 289), the band 280 is stretched a lesser, second amount in response to the same given amount of upward pivoting of the lower body support 160'. In other words, FIG. 13 shows the maximum resistance setting, and FIG. 14 shows the minimum resistance setting. Because the holes 289 are arranged in an arc centered about the pulley 284, the user is able to adjust the resistance without exerting force on the band 280.

Figure 15:
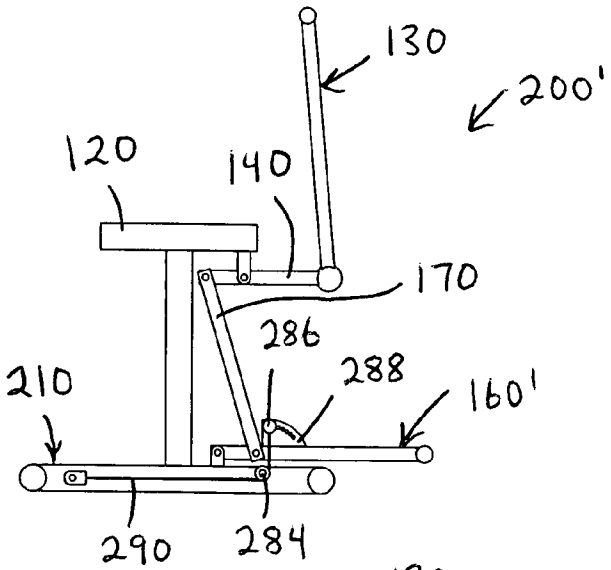
FIG. 15 is a side view of a fourth exercise device constructed according to the principles of the present invention.
Figure 16:
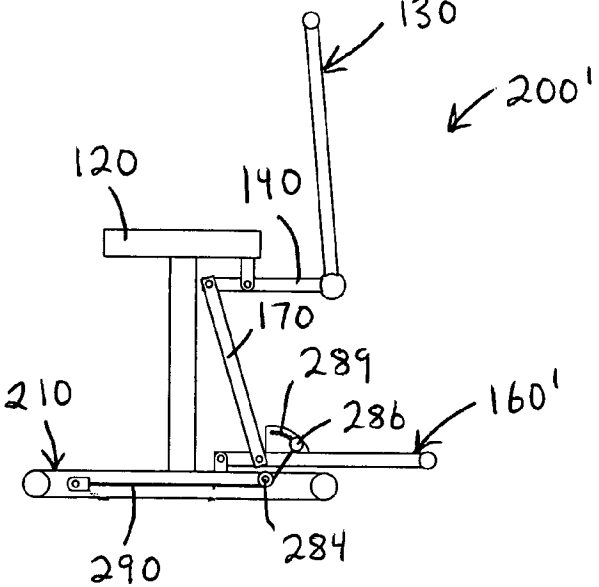
FIG. 16 is a side view of the exercise device of FIG. 15, showing the device at a different resistance setting.

Those skilled in the art will recognize that different types of resistance devices (e.g. springs, elastic cords, hydraulic cylinders, gas spring, weights, and the like) may be substituted for conventional elastic bands without departing from the scope of the present invention. For example, FIGS. 15-16 show a device 200' that is similar to the device 200, except that a bungee cord 290 has been substituted for the elastic band 280 and cable 282. The bungee cord 290 has a rearward end secured to the frame 210, and a forward end configured to receive and/or retain a fastener 286. An intermediate portion of the bungee cord 290 is routed about a pulley 285 on the frame 210. A bracket 288 is rigidly mounted on the lower leg support 160', and the fastener 286 is inserted through one of several holes 289 in the bracket 288.

When the device 200' is configured as shown in FIG. 15 (with the fastener 286 in the rearwardmost hole 289), the bungee cord 290 is stretched a first amount in response to a given amount of upward pivoting of the lower body support 160'. When the device 200' is configured as shown in FIG. 16 (with the fastener 286 in the forwardmost hole 289), the bungee cord 290 is stretched a lesser, second amount in response to the same given amount of upward pivoting of the lower body support 160'. In other words, FIG. 15 shows the maximum resistance setting, and FIG. 16 shows the minimum resistance setting. Because the holes 289 are arranged in an arc centered about the pulley 284, the user is able to adjust the resistance without exerting force on the bungee cord 290.

Figures 17, 18:
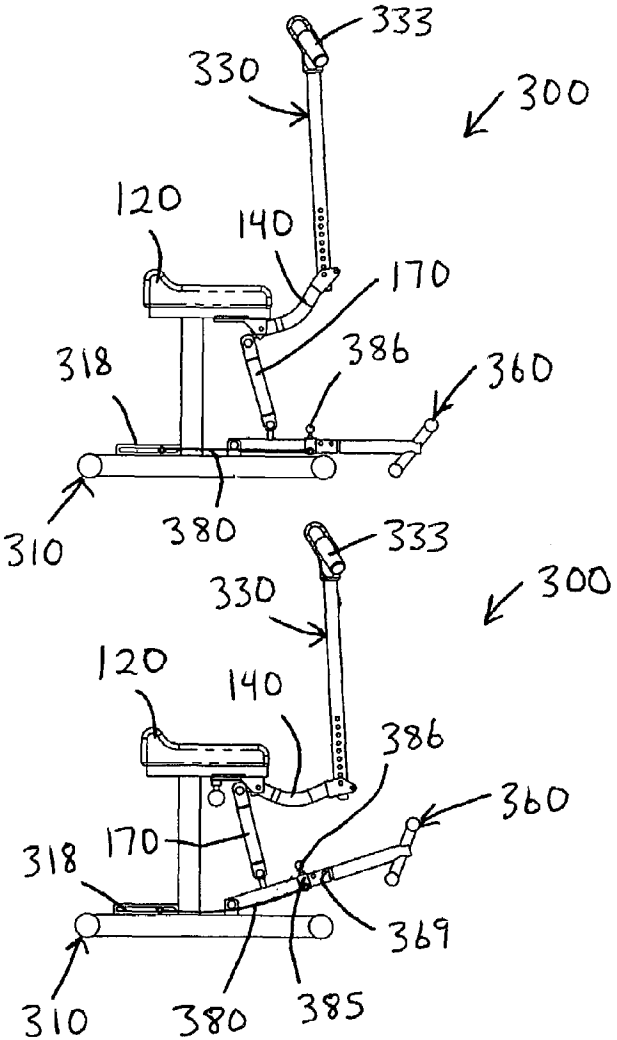
FIG. 17 is a side view of a fifth exercise device constructed according to the principles of the present invention.
FIG. 18 is a side view of the exercise device of FIG. 17, showing the device in an active position.

FIGS. 17-18 show an alternative embodiment exercise device 300 that is similar to the foregoing embodiments except that a leaf spring 380 is used to provide resistance to the abdominal exercise motion (and an upper body support 330 is provided with a different means for adjusting the height of the handles 333 relative to the seat 120). The leaf spring 380 has a rearward end that is slidably connected to a bracket 318 mounted on a rearward portion of the frame 310, and a forward end that is connected to a bracket 385 which in turn, is slidably mounted on the lower body support 360. A fastener 386 is inserted through the bracket 385 and into one of several holes 369 in the lower body support 360 to set the level of resistance.

When the fastener 386 is relatively rearward on the lower body support 360, the leaf spring 380 is subjected to force exerted at a first distance from the pivot axis of the lower body support 360. When the fastener 386 is relatively forward on the lower body support 360, the leaf spring 380 is subjected to force exerted at a second, relatively greater distance from the pivot axis of the lower body support 360. In other words, the level of resistance increases as the leaf spring 360 is moved rearward relative to the frame 310. Because the leaf spring 380 slides at both ends during adjustment, the user is able to adjust the resistance without exerting force on the leaf spring 380.

Figure 19:
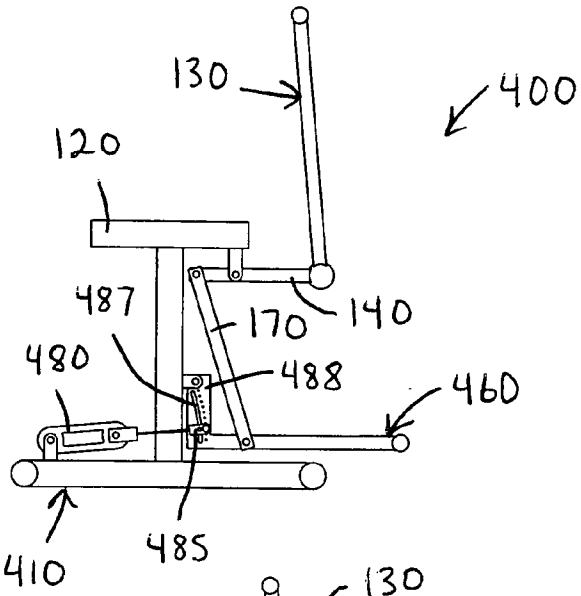
FIG. 19 is a side view of a sixth exercise device constructed according to the principles of the present invention.
Figure 20:
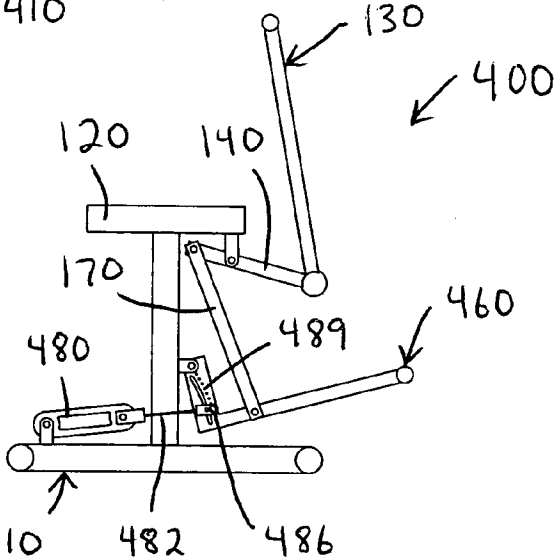
FIG. 20 is a side view of the exercise device of FIG. 19, showing the device in an active position.

FIGS. 19-20 show another device 400 that is similar to the device 100 except for the resistance arrangement (and an accompanying change in location of the pivot axis for the lower body support 460). In this regard, a conventional elastic band 480 has a rearward end secured to the frame 410, and a forward end secured to the rear end of a cable 482. An opposite, forward end of the cable 482 is configured to engage a bracket 488 that is rigidly connected to the lower leg support 460 (and pivotally connected to the frame 410). More specifically, a member 485 on the forward end of the cable 482 is slidably mounted in an arcuate slot 487 in the bracket 488, and the member 485 is also configured to receive and/or retain a fastener 486 that is inserted through one of several holes 489 in the bracket 488.

When the member 485 is relatively low on the bracket 488 (as shown in FIGS. 19-20), the band 480 is stretched a first amount in response to a given amount of upward pivoting of the lower body support 460. When the member 485 is relatively high on the bracket 488 (not shown), the band 480 is stretched a lesser, second amount in response to the same given amount of upward pivoting of the lower body support 460. In other words, the level of resistance increases as the member 485 is moved downward along the bracket 488. Because the holes 489 and the arcuate slot 487 are centered about the connection point between the band 480 and the frame 410, the user is able to adjust the resistance without exerting force on the band 480.

Figure 21:
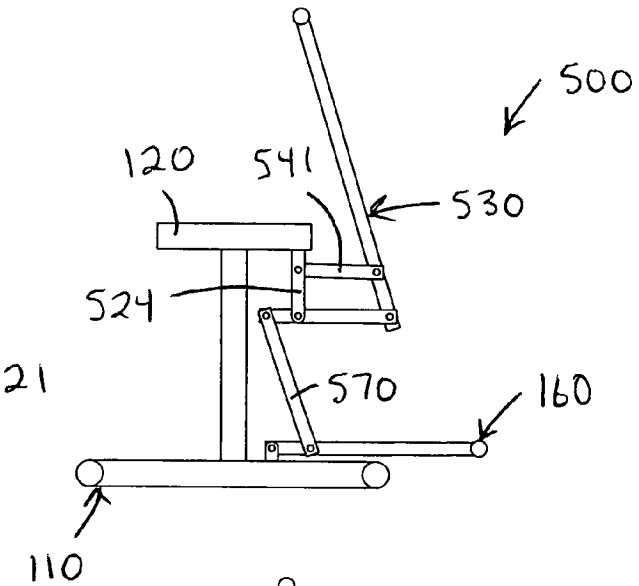
FIG. 21 is a side view of an seventh exercise device constructed according to the principles of the present invention.
Figure 22:
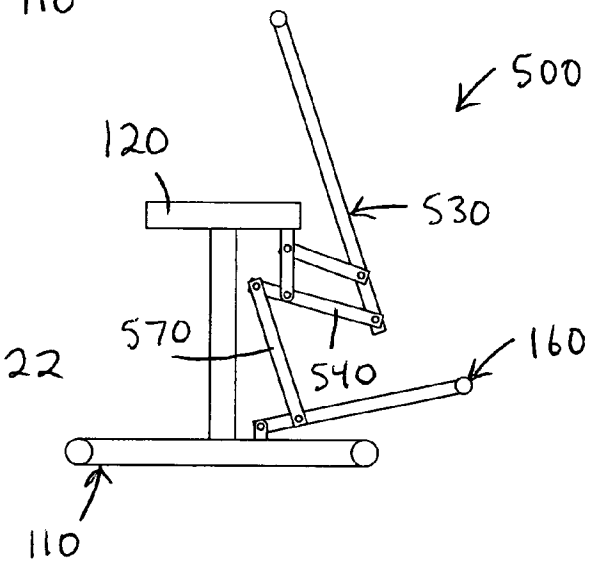
FIG. 22 is a side view of the exercise device of FIG. 21, showing the device in an active position.

FIGS. 21-22 show an alternative embodiment 500 that is similar to the previous embodiments except for the manner in which the upper body support 530 is supported. As on previous embodiments, a bar 540 is pivotally interconnected between a lower end of the upper body support 530 and an upper end of a link 570, and an intermediate portion of the bar 540 is pivotally connected to a trunnion 524 mounted beneath the seat 120. In addition, a second bar 541 is pivotally interconnected between the upper body support 530 and the trunnion 524. As a result of this arrangement, the upper body support 530 is constrained to remain in a fixed orientation relative to the frame 110.

Figure 23:
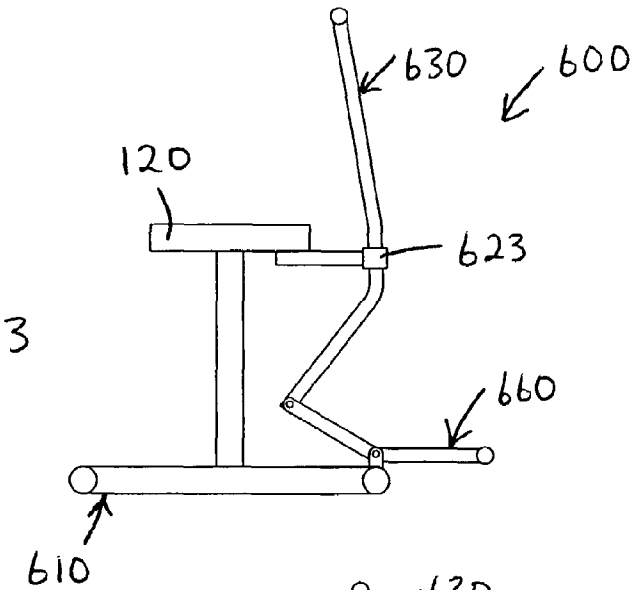
FIG. 23 is a side view of a eighth exercise device constructed according to the principles of the present invention.
Figure 24:
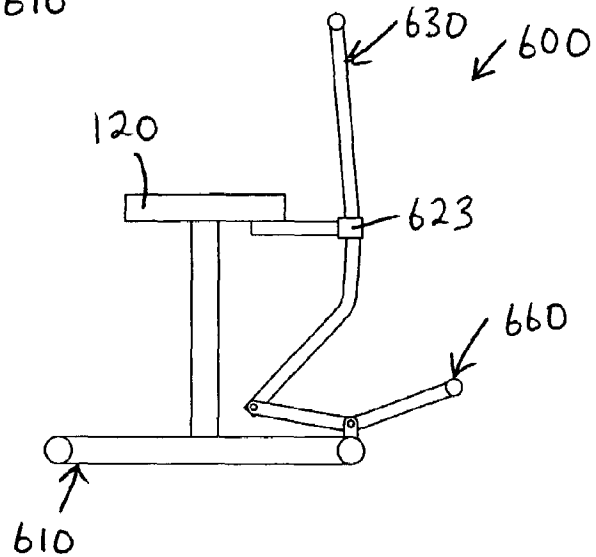
FIG. 24 is a side view of the exercise device of FIG. 23, showing the device in an active position.

FIGS. 23-24 show an alternative embodiment 600 having an upper body support 630 that is linked to a lower body support 660 in an alternative manner. More specifically, the upper body support 630 has an upper end that is configured to support a person's hands and/or chest (like those on other embodiments), and an intermediate portion that is slidably connected to the frame 610 at sleeve 623. In order to accommodate changes in orientation of the upper body support 630 relative to the frame 610, there is preferably a loose fit between the body support 630 and the sleeve 623, and/or a pivotal connection between the sleeve 623 and the frame 610. A lower end of the upper body support 630 is pivotally connected to a rearward end of the lower body support 660. An opposite, forward end of the lower body support 660 is configured to support a person's feet (like those on other embodiments), and an intermediate portion of the lower body support 660 is pivotally connected to the frame 610. As suggested by FIGS. 23-24, downward movement of the upper body support 630 causes upward movement of the lower body support 660.

Figure 25:
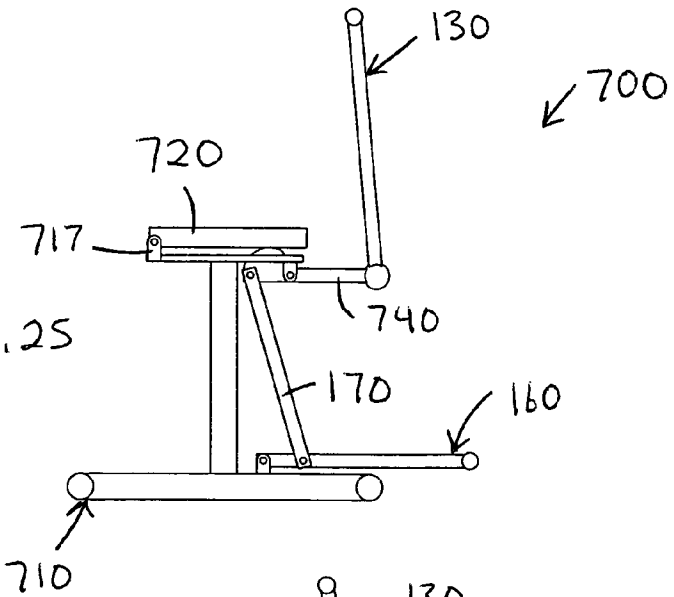
FIG. 25 is a side view of a ninth exercise device constructed according to the principles of the present invention.
Figure 26:
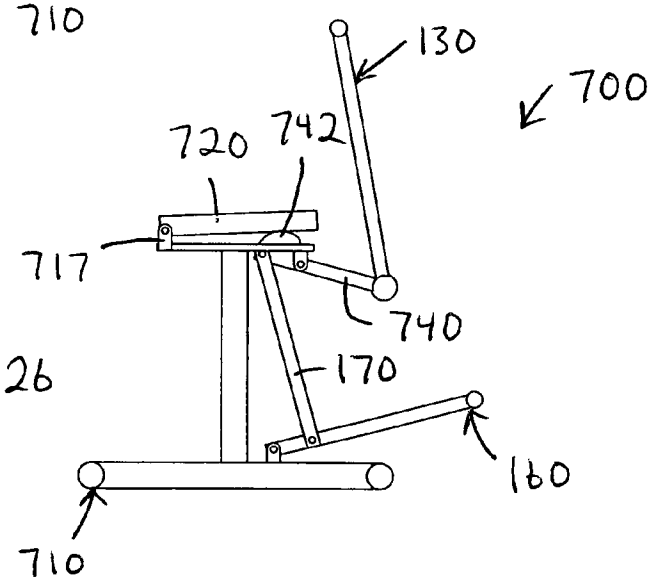
FIG. 26 is a side view of the exercise device of FIG. 25, showing the device in an active position.

The present invention may also be implemented in a manner that uses a person's body weight to provide resistance to exercise (alone or in combination with other forms of resistance described above). For example, FIGS. 25-26 show an exercise device 700 like the device 100, but modified to raise the seat 720 in response to downward movement of the upper body support 130. The upper body support 130 is connected to the lower body support 160 in the same manner as on the first device 100. However, a rearward end of the seat 720 is pivotally connected to a trunnion 717 on the frame 710, and an opposite, forward end of the seat 720 overlies a bearing member 742 on a rearward portion of the link 740. The bearing member 742 is configured and arranged to rest just beneath the seat 720 when the body supports 130 and 160 occupy respective rest positions (as shown in FIG. 25), and to push upward on the seat 720 in response to downward movement of the upper body support 130 (as shown in FIG. 26).

Figure 27:
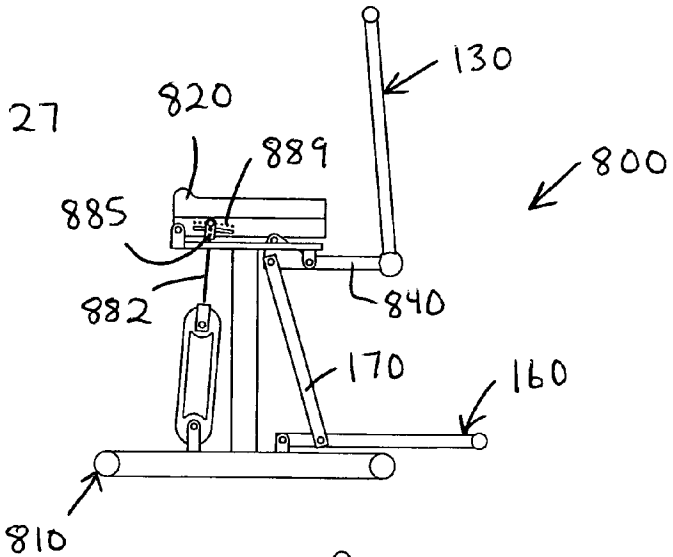
FIG. 27 is a side view of a tenth exercise device constructed according to the principles of the present invention.
Figure 28:
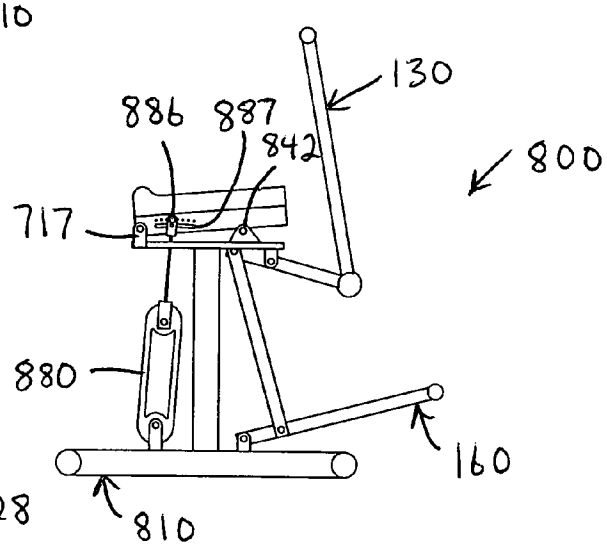
FIG. 28 is a side view of the exercise device of FIG. 27, showing the device in an active position.

FIGS. 27-28 show an exercise device 800 that combines the features of the device 700 (shown in FIGS. 25-26) and the device 400 (shown in FIGS. 19-20). In other words, the device 800 operates in the same manner as the device 700 but with additional resistance of the type provided on the device 400. As on the device 700, the upper body support 130 is connected to the lower body support 160; a rearward end of the seat 820 is pivotally connected to a trunnion 717 on the frame 810; and an opposite, forward end of the seat 820 overlies a bearing member 842 on a rearward portion of the link 840. The bearing member 842 (which may be a bar or a roller on this embodiment 800) is configured and arranged to rest just beneath the seat 820 when the body supports 130 and 160 occupy respective rest positions (as shown in FIG. 27), and to push upward on the seat 820 in response to downward movement of the upper body support 130 (as shown in FIG. 28).

Upward movement of the seat 820 is resisted by an elastic band arrangement (in addition to the weight of the seat 820 and anyone sitting on it). In this regard, an elastic band 880 has a lower end secured to the frame 810, and an opposite, upper end secured to the lower end of a cable 882. An opposite, upper end of the cable 882 is configured to engage the seat 820. More specifically, a member 885 on the upper end of the cable 882 is slidably mounted in an arcuate slot 887 in the seat 820, and the member 885 is also configured to receive and/or retain a fastener 886 that is inserted through one of several holes 889 in the seat 820.

When the member 885 is relatively rearward in the slot 887, the band 880 is stretched a first amount in response to a given amount of upward pivoting of the seat 820. When the member 885 is relatively forward in the slot 887, the band 880 is stretched a greater, second amount in response to the same given amount of upward pivoting of the seat 820. In other words, the level of resistance increases as the member 885 is moved forward along the slot 887. Because the holes 889 and the arcuate slot 887 are centered about the connection point between the band 880 and the frame 810, the user is able to adjust the resistance without exerting force on the band 880.

Figures 29, 30:
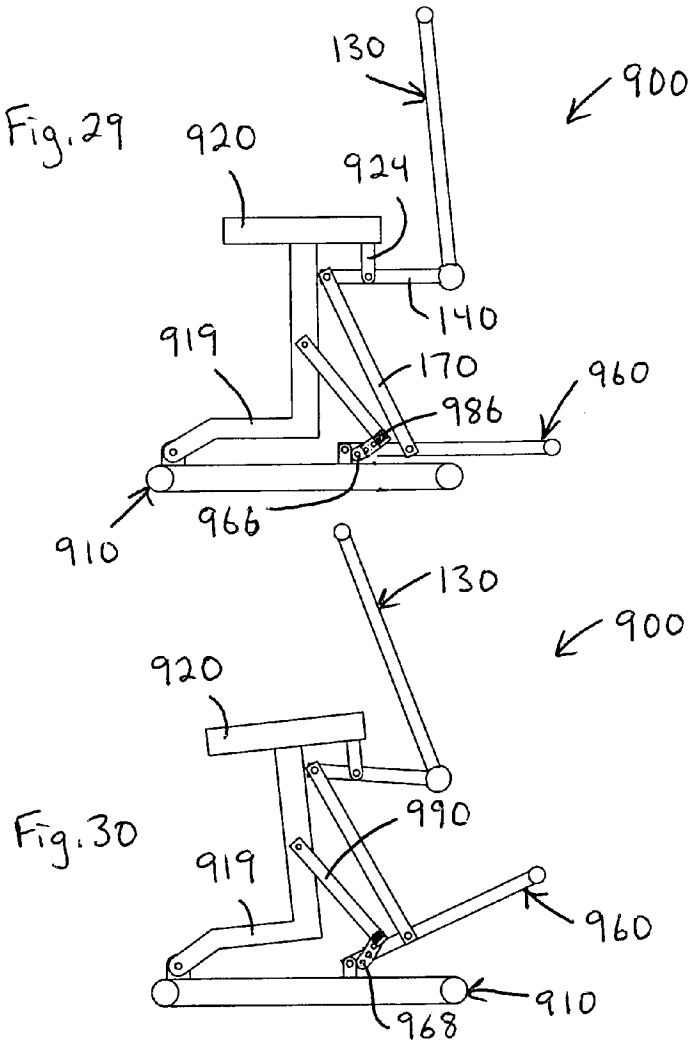
FIG. 29 is a side view of a eleventh exercise device constructed according to the principles of the present invention.
FIG. 30 is a side view of the exercise device of FIG. 29, showing the device in an active position.

FIGS. 29-30 show another device 900 that uses a person's body weight to resist downward movement of the upper body support 130. The device 900 includes a seat support 919 having a lower end that is pivotally connected to a rearward end of the frame 910. The seat 920 is rigidly mounted on an opposite, upper end of the seat support 919. A trunnion 924 extends downward from a forward portion of the seat 920 to support and intermediate portion of the link 140, and the link 170 is interconnected between the link 140 and the lower body support 960. Unlike the embodiments described above, another link 990 is pivotally interconnected between the lower body support 960 and the seat support 919. More specifically, a bracket 966 is provided on the lower body support 960, and a fastener 986 is inserted through a hole in the link 990 and one of several holes 968 in the bracket 966.

When the link 990 is secured to an end of the bracket 966 proximate the pivot axis of the lower body support 960, the seat 920 pivots a first amount in response to a given amount of upward movement of the lower body support 960. When the link 990 is secured to an opposite end of the bracket 966, the seat 920 pivots a greater, second amount in response to the same amount of upward movement of the lower body support 960. In other words, the level of resistance increases as the fastener 986 is moved away from the pivot axis of the lower body support 960. The holes 968 in the bracket 966 are arranged in an arc centered about the pivot axis defined between the link 990 and the seat support 919, so the fastener 986 adjustment may be made without moving the seat 920 from its rest position.

Figures 31, 32:
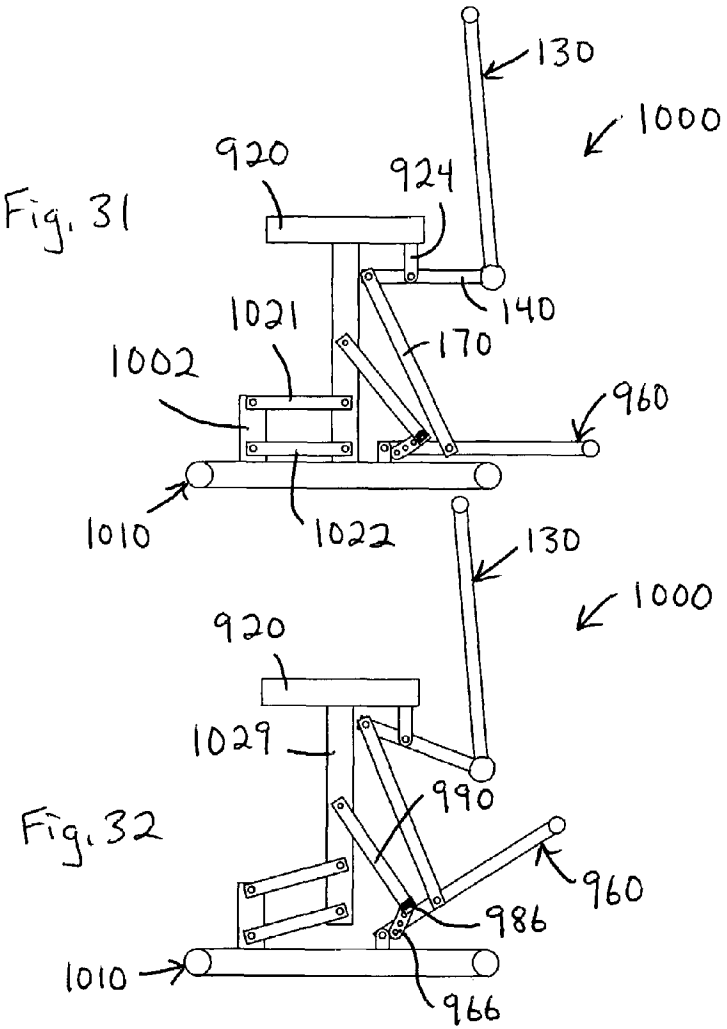
FIG. 31 is a side view of a twelfth exercise device constructed according to the principles of the present invention.
FIG. 32 is a side view of the exercise device of FIG. 31, showing the device in an active position.

FIGS. 31-32 show a device 1000 that is similar to the device 900, but with a different seat supporting arrangement. More specifically, the seat 920 is mounted on top of a seat support 1029, and first and second parallel links 1021 and 1022 are pivotally interconnected between the seat support 1029 and a frame member 1002. The links 1021 and 1022 constrain the seat 920 to remain in a fixed orientation relative to the frame 1010. FIG. 31 shows the device 1000 in a rest position, and FIG. 32 shows the device 1000 in an active position.

Figure 33:
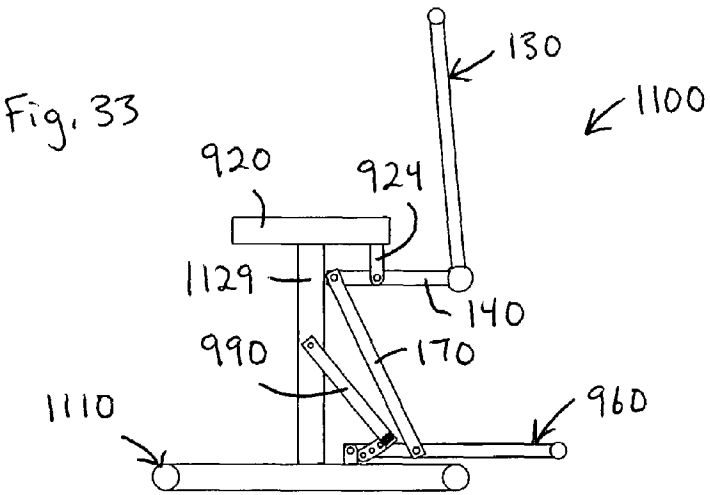
FIG. 33 is a side view of thirteenth exercise device constructed according to the principles of the present invention.
Figure 34:
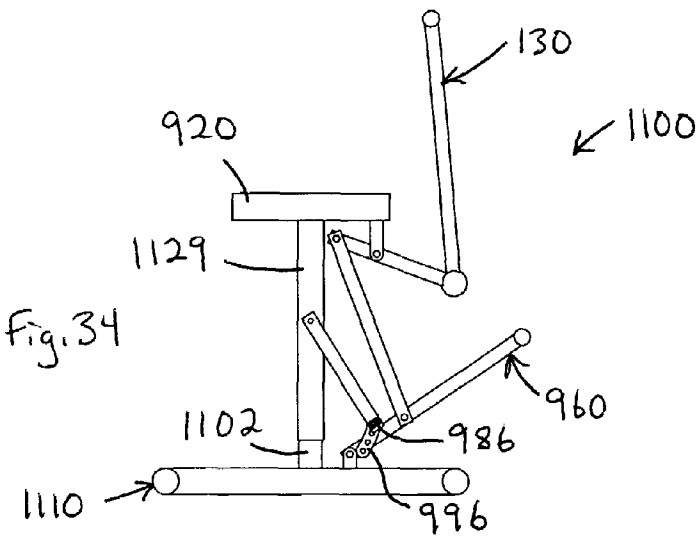
FIG. 34 is a side view of the exercise device of FIG. 33, showing the device in an active position.

FIGS. 32-34 show another device 1100 that is similar to the device 900, but with another unique seat supporting arrangement. On this embodiment 1100, the frame 1110 includes a post 1102 that extends upward from a middle portion of the floor engaging base. A seat support 1129 is slidably mounted on the post 1102, and the seat 920 is rigidly mounted on top of the seat support 1129. The additional link 990 is pivotally interconnected between the seat support 1129 and the lower body support 960, thereby constraining the seat support 1129 to move upward in response to upward movement of the lower body support 960.

The present invention may also be described in terms of various methods with reference to the foregoing embodiments. One such method comprises the steps of providing an exercise apparatus having a frame; a seat mounted on the frame; a handlebar movably mounted on a first portion of the frame and extending generally vertically upward in front of the seat; a foot support movably mounted on a second portion of the frame and extending generally horizontally outward beneath the handlebar and forward of the seat, wherein the foot support has a forward end sized and configured to support a user's feet, a first rearward portion pivotally connected to the frame, and a second rearward portion linked to the handlebar in a manner that links downward movement of the handlebar to upward movement of the foot support. A user sits upright on the seat, places his hands on the handlebar, and places his feet on the foot support. The user then lifts his feet by lifting upward on the foot support, and/or pushing downward on the handlebar.

The present invention has been described with reference to particular embodiments and specific applications, and various features of different embodiments may be mixed and matched in numerous ways to arrive at additional embodiments. Moreover, this disclosure will also enable persons skilled in the art to recognize additional embodiments and/or applications that incorporate the essence of the present invention. Among other things, various parts of the present invention may be provided in different shapes or arrangements to change the appearance of the apparatus and/or the relative movements of the parts. Also, any of various shrouds may be mounted beneath the seat and about the stanchion and proximate parts to improve the appearance of the apparatus and/or cover potential pinch points. Any such shroud may be provided with an opening or a remote operator to facilitate adjustment of the resistance device (if any) on the apparatus. With the foregoing in mind, the scope of the present invention is to be limited only to the extent of the following claims.

What is claimed is:

1. An abdominal exercise apparatus, comprising:

a frame;

a seat mounted on the frame;

a handlebar movably mounted on a first portion of the frame and extending generally vertically upward in front of the seat;

a foot support pivotally mounted on a discrete, second portion of the frame and extending generally horizontally outward beneath the handlebar and forward of the seat, wherein the foot support has a forward end sized and configured to support a user's feet, and a relatively rearward portion movably linked to the handlebar in a manner that links downward, clockwise movement of the handlebar to upward, counter-clockwise movement of the foot support; and an adjustable resistance means device interconnected between the frame and at least one of the handlebar and the foot support, for resisting upward movement of the foot support relative to the frame.

2. The exercise apparatus of claim 1, wherein the forward end of the foot support has upper and lower foot engaging portions configured and arranged to accommodate a person's feet therebetween.

3. The exercise apparatus of claim 1, wherein the seat is rigidly connected to the frame.

4. An abdominal exercise apparatus, comprising:

a frame;

a seat mounted on the frame;

a handlebar movably mounted on a first portion of the frame and extending generally vertically upward in front of the seat;

a foot support pivotally mounted on a discrete, second portion of the frame and extending generally horizontally outward beneath the handlebar and forward of the seat, wherein the foot support has a forward end sized and configured to support a user's feet, and a relatively rearward portion movably linked to the handlebar in a manner that links downward movement of the handlebar to upward movement of the foot support;

a handlebar link having a forward end pivotally connected to a lower end of the handlebar, an intermediate portion pivotally connected to the frame, and a rearward portion pivotally connected to an upper end of an intermediate link, wherein an opposite, lower end of the intermediate link is pivotally connected to the relatively rearward portion of the foot support.

5. The exercise apparatus of claim 4, wherein a rearward end of the foot support is pivotally connected to the frame, and the relatively rearward portion of the foot support is disposed between the rearward end of the foot support and the forward end of the foot support.

6. The exercise apparatus of claim 4, further comprising an adjustable resistance means interconnected between the frame and a rearward end of the handlebar link, for resisting downward movement of the handlebar relative to the frame.

7. The exercise apparatus of claim 4, further comprising an adjustable resistance means interconnected between the frame and the foot support, for resisting upward movement of the foot support relative to the frame.

8. An abdominal exercise apparatus, comprising:

a frame;

a seat mounted in place on the frame;

a handlebar having a first end sized and configured to support a person's hands, an intermediate portion pivotally connected to the frame, and an opposite, second end;

a foot support having a first end sized and configured to support a person's feet, and an opposite, second end pivotally connected to the frame; and at least one link pivotally interconnected between the second end of the handlebar and an intermediate portion of the foot support to link downward movement of the handlebar to upward movement of the foot support, wherein the at least one link includes a connector link that extends generally perpendicular to the foot support, and the handlebar includes a generally horizontal section that extends generally parallel to the connector link.

9. The exercise apparatus of claim 8, wherein the handlebar pivots about a first pivot axis relative to the frame, and the foot support pivots about a discrete, second pivot axis relative to the frame.

10. The exercise apparatus of claim 9, wherein each said axis extends underneath a planform defined by the seat.

11. An abdominal exercise apparatus, comprising:

a frame;

a seat mounted in place on the frame;

a handlebar having a first end sized and configured to support a person's hands, an intermediate portion pivotally connected to the frame, and an opposite, second end;

a foot support having a first end sized and configured to support a person's feet, and an opposite, second end pivotally connected to the frame;

at least one link pivotally interconnected between the second end of the handlebar and an intermediate portion of the foot support to link downward movement of the handlebar to upward movement of the foot support; and an adjustable resistance means interconnected between the frame and the handlebar, for resisting downward movement of the handlebar relative to the frame.

12. An abdominal exercise apparatus, comprising:

a frame;

a seat mounted in place on the frame;

a handlebar having a first end sized and configured to support a person's hands, an intermediate portion pivotally connected to the frame, and an opposite, second end;

a foot support having a first end sized and configured to support a person's feet, and an opposite, second and pivotally connected to the frame;

at least one link pivotally interconnected between the second end of the handlebar and an intermediate portion of the foot support to link downward movement of the handlebar to upward movement of the foot support; and an adjustable resistance means interconnected between the frame and the foot support, for resisting upward movement of the foot support relative to the frame.

* * * * *